United States Patent [19]

Toyota

[11] Patent Number: 4,790,469

[45] Date of Patent: Dec. 13, 1988

[54] TAPE FEED APPARATUS

[75] Inventor: Sumio Toyota, Toyama, Japan

[73] Assignee: Yoshida Kogyo K.K., Tokyo, Japan

[21] Appl. No.: 896,066

[22] Filed: Aug. 13, 1986

[30] Foreign Application Priority Data

Aug. 14, 1985 [JP] Japan ..... 60-123999[U]

[51] Int. Cl.[4] ..... A41H 37/00; B65H 20/22

[52] U.S. Cl. ..... 226/129; 226/133; 227/18

[58] Field of Search ..... 226/127–129, 226/133, 134, 132, 130, 16, 90, 76, 83; 227/15–18

[56] References Cited

U.S. PATENT DOCUMENTS

| | | | |
|---|---|---|---|
| 906,110 | 12/1908 | Covington | 226/127 |
| 1,166,995 | 1/1916 | Konerman | 226/132 |
| 1,565,523 | 12/1925 | Stuart | 227/21 |
| 2,507,446 | 5/1950 | Krueger | 226/127 X |
| 2,519,701 | 8/1950 | Richardson | 226/127 X |
| 2,654,598 | 10/1953 | Krueger | 226/127 X |
| 2,671,659 | 3/1954 | Hummel | 226/132 |
| 2,691,524 | 10/1954 | Hummel | 226/132 |
| 3,084,344 | 4/1963 | Schmidt | 227/18 |
| 3,292,837 | 12/1966 | Heil et al. | 227/18 X |
| 3,838,519 | 10/1974 | Chick | 226/90 X |
| 4,029,247 | 7/1977 | Sakariason | 226/90 X |
| 4,434,928 | 3/1984 | Seki | 227/16 |

FOREIGN PATENT DOCUMENTS

| | | |
|---|---|---|
| 0053796 | 6/1982 | European Pat. Off. . |
| 58-52247 | 11/1983 | Japan . |

*Primary Examiner*—Stuart S. Levy
*Assistant Examiner*—Lynn M. Sohacki
*Attorney, Agent, or Firm*—Hill, Van Santen, Steadman & Simpson

[57] ABSTRACT

In a fastener attaching machine, a tape feed apparatus comprises a shaft manually rotatably supported by a holder, a feed roller mounted on the shaft via a one-way clutch for rotation with the shaft in one direction only, a spring normally urging the shaft to be rotated in the other direction, and a stop means for restricting the angle of the manual rotation of said shaft.

3 Claims, 4 Drawing Sheets

TAPE FEED APPARATUS

BACKGROUND OF THE INVENTION

1. Field of the Invention

The present invention generally relates to a machine for attaching a fastener member such as a hook and eye to a garment fabric, with a reinforcement tape sandwiched between the garment fabric and a washer. More particularly, the invention relates to an apparatus for feeding such reinforcement tape to an attaching station.

2. Description of the Prior Art

Japanese Utility Model Post-Examination Publication (Kokoku) No. 58-52247 discloses an apparatus for feeding a tape on and along a table by a feed roller which is disposed under the table and which is actuated by means of an air cylinder. However, it is often advantageous in work efficiency that the feed roller be rotated manually. Practically, this manual rotation does not guarantee a uniform angle of rotation, thus causing a non-uniform length of the tape fed by each stroke.

SUMMARY OF THE INVENTION

It is therefore an object of the present invention to provide a tape feed apparatus in which a feed roller can be rotated by hand through a uniform angle by each stroke.

According to the present invention, a tape feed appartus comprises a manually rotatable shaft rotatably supported by a holder, a feed roller mounted on said shaft via a one-way clutch for rotation with the shaft in one direction only, a spring normally urging the shaft to be rotated in the other direction, and a stop means for restricting the angle of the manual rotation of the shaft.

Many other advantages, features and additional objects of the present invention will become manifest to those versed in the art upon making reference to the detailed description and the accompanying drawings in which a preferred embodiment incorporating the principles of the present invention is shown by many of illustrated example.

DETAILED DESCRIPTION

Figure 4:
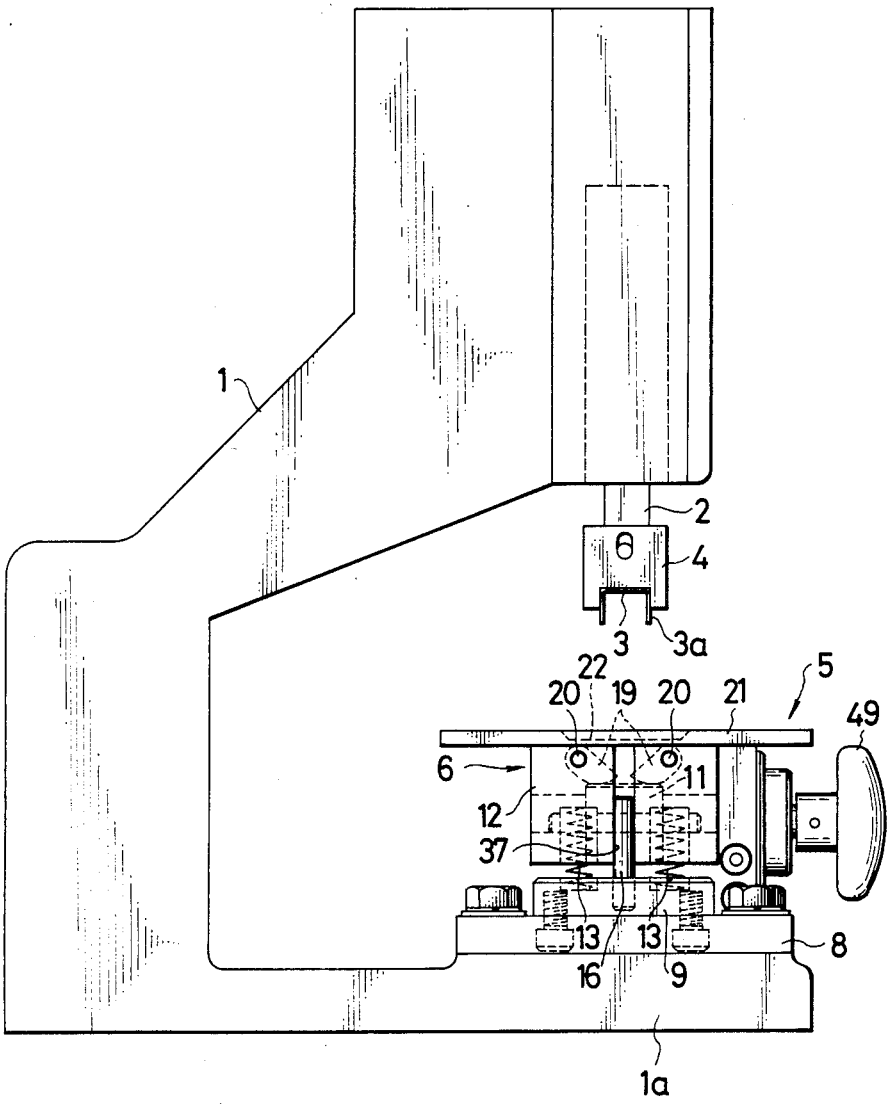
FIG. 4 is a leftside elevational view of the entire fastener attaching machine.

FIG. 4 shows a fastener attaching machine comprising a frame 1, a ram 2 vertically movably supported by the frame, a punch 4 mounted on a lower end of the ram 2 for receiving a fastener member 3, such as a hook or an eye, and a die unit 5 fixedly secured to a lower portion 1*a* of the frame 1.

Figure 1:
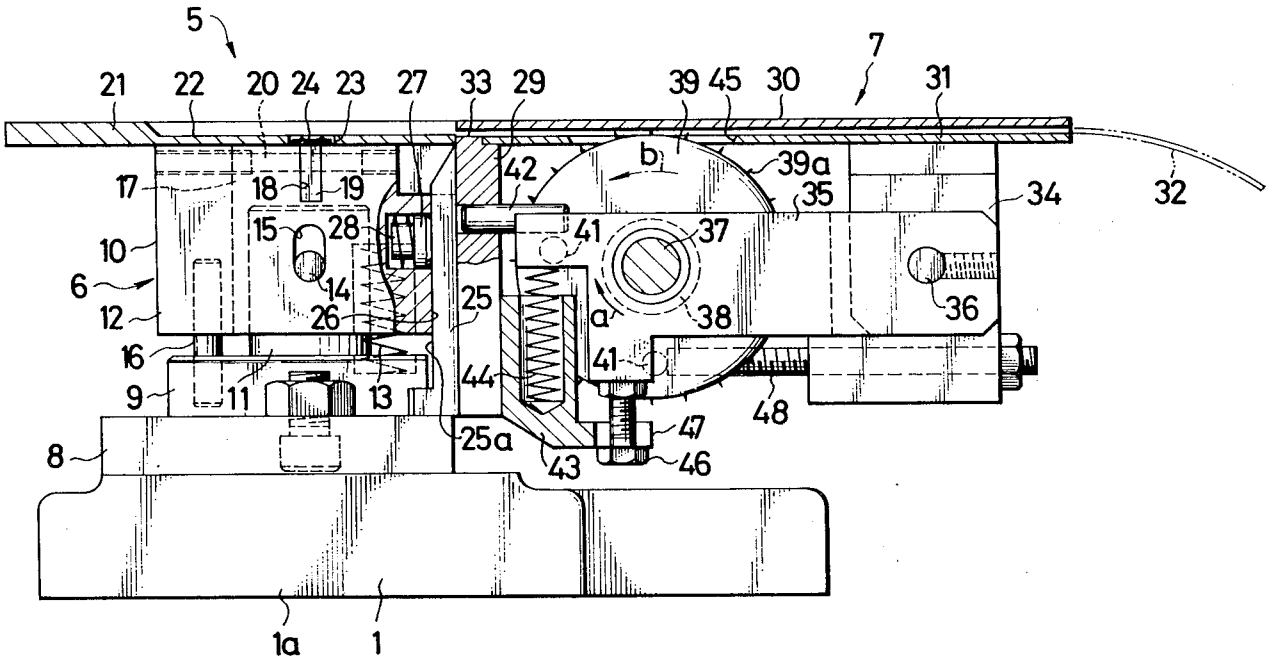
FIG. 1 is a cross-sectional view of a die unit of a fastener attaching machine, showing a tape feed apparatus embodying the present invention.
Figure 2:
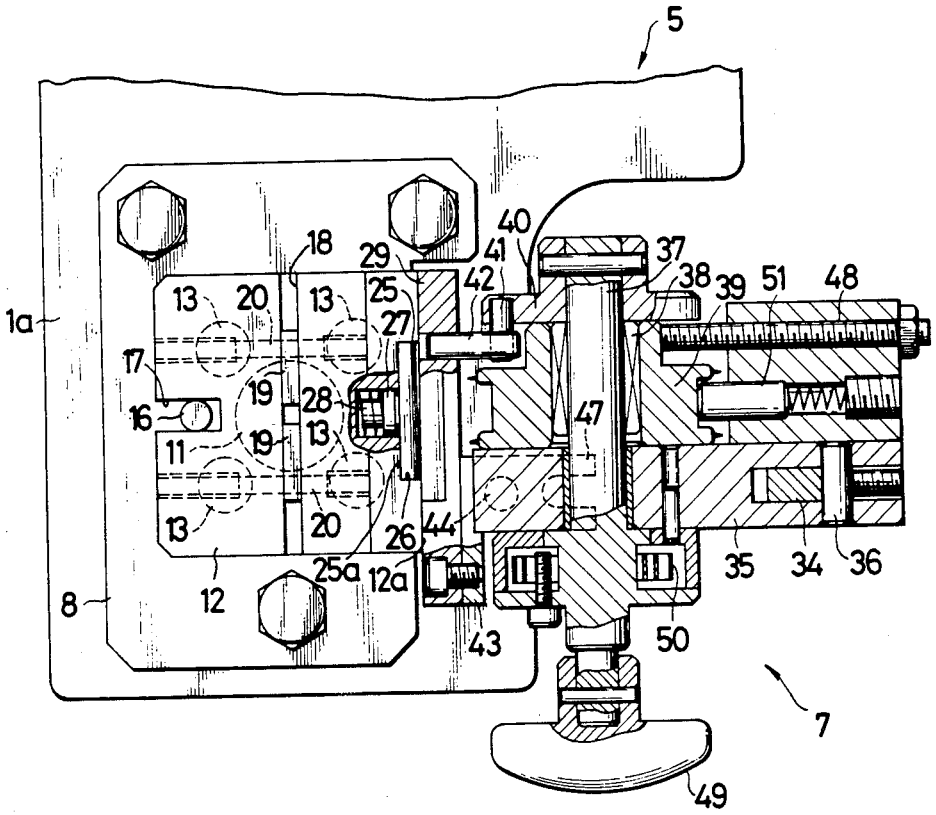
FIG. 2 is a plan view, partially in cross section, of FIG. 1.

As shown in FIGS. 1 and 2, the die unit 5 generally comprises a die mechanism 6 and a tape feed apparatus 7. The die mechanism 6 includes a base 8 fixedly secured to the lower portion 1*a* of the frame 1, an attachment plate 9 fixedly secured to the base 8, and a die 10 mounted on the attachment plate 9. The die 10 includes a generally cubic block 12 vertically slidably supported by a cylindrical guide rod 11. The block 12 is normally urged upwardly by four compression springs 13; this upward movement of the block 12 is restricted by a stop pin 14 projecting from the guide rod 11 into a vertical slot 15 in the block 12. A pin 16 is mounted on the attachment plate 9 and is received in a vertical groove 17 of the block 12, thus preventing the block 12 from rotating about the guide rod 11. The block 12 has in its upper portion a vertical slit 18 in which a pair of claws 19, 19 are vertically pivotally mounted by a pair of pins 20, 20, respectively, supported by the block 12. The pair of claws 19, 19 pivot downwardly by their own weight to abut against the top surface of the guide rod 11.

A table 21 is supported on the upper surface of the block 12 and has an upwardly opening tape guide recess 22. The table also has an opening 23 communicating with the guide recess 22 and having a width larger than the slit 18 for receiving a washer 24.

A cutter 25 is held against the base 8 by the attachment plate 9 and is received in a side recess 26 in a side surface 12*a* of the block 12. A pusher pin 27 is carried by the block 12 and is normally urged by a spring 28 rightwardly in FIGS. 1 and 2 against one side surface 25*a* of the cutter 25, thus bringing the cutter 25 into close contact with a cutter die 29 fixedly secured to the side surface 12*a* of the block 12.

The tape feed apparatus 7 includes a tape guide 30 fixedly secured to the cutter die 29 and defining a guide channel 31 of substantially the same width and thickness as a tape 32 through which channel the tape 32 is to be fed over the top surface 33 of the cutter die 29 and hence into the tape guide recess 22 of the table 21.

The tape feed apparatus 7 also includes a holder 35 which is vertically pivotally connected at its one end to a bracket 34 by a pin 36, the bracket 34 being fixedly secured to the tape guide 30. A horizontal shaft 37 is rotatably supported by the holder 35 and extends therethrough. A feed roller 39 is mounted on the shaft 37 via a one-way clutch 38 and is prevented by a pusher plate 40 from being removed from the shaft 37, the pusher plate 40 being fixedly mounted on the shaft 37. A torsion spring 50 (FIG. 2) acts betweeen the holder 35 and the shaft 37 to normally urge the latter to rotate clockside, i.e. in a direction of an arrow a in FIG. 1. This clockwise rotation of the shaft 37 is restricted by a stop means which includes a stop pin 42 mounted on the cutter die 29 and engageable with a pin 41 mounted on the pusher plate 40 at an eccentric position. The angle of one-way rotation of the feed roller 39 is thus restricted.

A compression spring 44 acts between a bracket 43 fixedly secured to the lower portion of the cutter die 29 and the other or free end of the holder 35 to normally urge the holder 35 to pivot upwardly (clockwise in FIG. 1) so that a plurality of peripheral projections 39*a* on the feed roller 39 is projectable through an opening 45 in the tape guide 30 into the guide channel 31. The upward movement of the holder 35 is restricted by a bifurcated stop projection 47 which is an extension of the bracket 43 for engagement with a head of a screw 46 threadedly supported on the holder 35. The uppermost position of the feed roller 39 may be adjusted by turning the screw 46.

The stop means also includes a stop screw 48 adjustably supported on the lower portion of the holder 35 for engagement with the pin 41 to restrict counterclockwise (FIG. 1) rotation of the shaft 37. Thus the stop screw 48 and the stop pin 42 jointly restrict the angle through which the shaft 37 and hence the feed roller 39 is to be turned or rotated.

Figure 3:
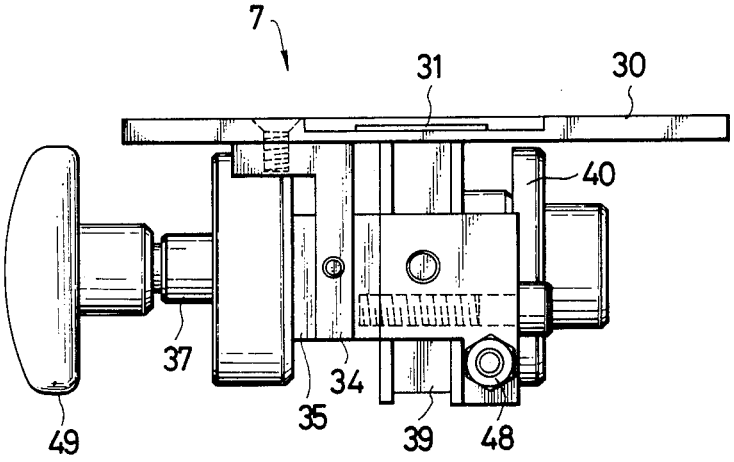
FIG. 3 is a rightside elevational view of FIG. 1.

As shown in FIGS. 2 and 3, a knob 49 is mounted on the other or front end of the shaft 37 and is adapted to be turned or rotated counterclockwise, i.e. in the direction of an arrow b in FIG. 1, against the bias of the spring 50 by hand. When the knob 49 is freed from the operator's hand, the pin 41 remains in abutting engagement with the stop pin 42 under the resilience of the spring 50, as illustrated in broken lines in FIG. 1.

The tape feed apparatus 7 additionally has a brake 51 (FIG. 2) slidably supported on the bracket 34 and is normally urged by an unnumbered spring against the feed roller 39 for preventing the latter from reverse (clockwise in FIG. 1) rotation due to the play of the one-way clutch 38.

In operation, when the shaft 37 is turned or rotated counterclockwise, i.e. in the direction of the arrow b in FIG. 1 by manipulating the knob 49, the feed roller 39 is rotated in the same direction by the action of the one-way clutch 38 to thereby feed the tape 32 toward the die 10.

This counterclockwise rotation of the shaft 37 is terminated when the pin 41 abuts against the stop screw 48, as illustrated in dash-and-two-dot lines in FIG. 1. Thus the angle of manual rotation of the feed roller 39 is restricted to a constant value.

In this condition, as the knob 49 is freed from the operator's hand, the shaft 37 is turned or rotated clockwise, i.e. in the direction of the arrow a in FIG. 1, under the resilience of the spring 50 (FIG. 2) until the pin 41 abuts against the stop pin 42. At that time the feed roller 39 is prevented from clockwise rotation by the action of one-way clutch 38.

Since the feed roller 39 is turnable or rotatable between a first position in which the pin 41 is disposed against the stop pin 42 and a second position in which tne pin 41 is disposed against the stop screw 48, the angle through which the feed roller 39 is to be manually turned or rotated is constant so that a uniform length of the tape 32 is fed in response to each manual turn or rotation of the feed roller 39.

For withdrawing the tape 32 from the tape guide 30 rightwardly in FIG. 1, firstly the holder 35 is pivotally moved by hand downwardly or counterclockwise in FIG. 1 against the bias of the spring 44 to lower the feed roller 39 until the peripheral projections 39*a* of the feed roller 39 are retracted from the guide channel 31 of the tape guide 30, thus releasing the tape 32 from the peripheral projections 39*a* of the feed roller 39. Then the tape 32 is merely pulled rightwardly.

For attaching the fastener element such as a hook or an eye 3 to a garment fabric (not shown), the tape 32 is fed, in the above-mentioned manner, to the tape guide recess 22 of the table 21 over a washer 24 received in the opening 23 of the table 21, and then the non-illustrated garment fabric is placed over the tape 32. Subsequently, as the ram 2 (FIG. 4) is lowered with the punch 4 toward the table 21, a pair of spikes 3*a* of the fastener member 3 carred by the punch 4 is forced to penetrate through the garment fabric and the tape 32 and then to contact the washer 24.

With continued lowering of the ram 2, the block 12 is depressed downwardly by the ram 2 to bring the claws 19 against the upper surface of the guide rod 11. At that time, since the guide rod 11 is stationary, the claws 19 are upwardly pivotally moved with respect to the block 12 to push the washer 24 upwardly, thus causing the spikes 3*a* of the fastener member 3 to be crimped over the washer 24. As a result, the fastener member 3 has been attached to the garment fabric, with the tape 32 sandwiched between the garment fabric and the washer 24.

Concurrently with this lowering of the block 12, the cutter die 29 also is lowered relative to the stationary cutter 25 so that the tape 32 is cut by the cutter 25.

With the tape feed apparatus 7, it is possible to manually rotate the feed roller 39 through a uniform angle, that is, to feed a constant length of the tape 32 by each manual rotation of the feed roller 39, partly because the feed roller 39 is manually rotatably mounted on the shaft 37 via the one-way clutch 38, and partly because the angle of rotation of the shaft 37 is restricted to a constant value jointly by the stop pin 42 and the stop screw 48.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for feeding a tape, comprising:

(a) a tape guide defining a guide channel through which the tape is to be fed;

(b) a holder pivotally connected at one end to a first bracket fixedly secured to said tape guide;

(c) a shaft rotatably supported by said holder and connected at one end to a knob for rotation by hand;

(d) a first spring acting between said holder and said shaft so as to normally urge the latter to rotate in one direction;

(e) a feed roller mounted on said shaft via a one-way clutch for rotation with said shaft only when the latter is manually rotated in the other direction against the bias of said first spring, said feed roller having a peripheral portion normally projecting into said guide channel of said tape guide for engagement with the tape to feed the same in response to the rotation of said feed roller, said feed roller further having a plurality of peripheral projections on said peripheral portion for piercing the tape so as to prevent the latter from slipping on said peripheral portion;

(f) a second spring acting between a second bracket and a free end of said holder so as to normally urge said holder to pivot so that said peripheral projections of said feed roller are projectable into said guide channel of said tape guide; and (g) means for restricting an angle of the rotation of said shaft including a pusher plate fixedly mounted on said shaft, a pin mounted on said pusher plate at an eccentric position, a stop pin secured to said tape guide for engagement with said pin so as to restict the rotation of said shaft in said one direction, and a stop screw adjustably supported by said first bracket and angularly spaced from said stop pin by a predetermined angle about said shaft for engagement with said pin so as to restrict the rotation of said shaft in said other direction.

2. A tape feed apparatus according to claim 1, further including braking means for preventing said feed roller from undue rotation in said one direction due to any play of said one-way clutch.

3. A tape feed apparatus according to claim 2, said feed roller having a central peripheral groove devoid of said peripheral projections, said brake means including a brake shoe slidably supported on said first bracket and a third spring normally urging said brake shoe into said central peripheral groove and against said feed roller.

* * * * *